United States Patent [19]

Warncke et al.

[11] 4,172,454

[45] Oct. 30, 1979

[54] HEAT AND GAS PROTECTION SUIT

[75] Inventors: Ernst Warncke, Lubeck; Adalbert Pasternack, Bad Schwartau, both of Fed. Rep. of Germany

[73] Assignee: Drägerwerk Aktiengesellschaft, Fed. Rep. of Germany

[21] Appl. No.: 837,188

[22] Filed: Sep. 28, 1977

[30] Foreign Application Priority Data

Oct. 1, 1976 [DE] Fed. Rep. of Germany ..... 2644305

[51] Int. Cl.[2] ..... A62B 7/00; A62B 17/00

[52] U.S. Cl. ..... 128/142.5; 128/212; 62/259; 128/379; 128/399; 165/46; 2/2.1 R

[58] Field of Search ..... 128/142.7, 142.6, 142.5, 128/142.4, 142.3, 142.2, 142 R, 204, 203, 202, 191 R, 191 A, 212, 379, 399; 165/46, 134; 62/259, 385, 293; 2/2.1 R, 2.1 A; 55/269

[56] References Cited

U.S. PATENT DOCUMENTS

| | | | |
|---|---|---|---|
| 771,801 | 10/1904 | Andrew | 128/142 R |
| 2,881,758 | 4/1959 | Motsinger | 128/142.5 X |
| 3,498,071 | 3/1970 | Tremont | 62/293 X |
| 3,556,205 | 1/1971 | Harwood, Jr. | 165/46 |
| 3,670,518 | 6/1972 | Esposito | 128/142.5 X |
| 3,715,867 | 2/1973 | Aoi | 55/269 X |
| 3,869,871 | 3/1975 | Rybalko et al. | 62/259 X |

*Primary Examiner*—Henry J. Recla
*Attorney, Agent, or Firm*—McGlew and Tuttle

[57] ABSTRACT

A suit for the protection of a wearer's body and head from heat and gas comprises an inner suit adapted to cover the wearer's body and head and having a tubular flow channel therethrough for the passage of a cooling liquid such as silicone. An outermost suit overlies the innermost suit and it has a body covering and a head covering portion. The head covering portion includes a face mask. A heat exchanger is mounted so as to connect into the outermost suit and includes a coolant chamber for containing a vaporizable coolant therein. The vaporizable coolant such as carbon dioxide is maintained under pressure and the cooling liquid is circulated into heat exchange relationship therewith so as to cool down the wearer's body. In addition the device includes a respirator for circulating respiratory air to the face of the wearer which advantageously includes a passage adjacent the heat exchanger so that the incoming air may also be cooled if desired. In one embodiment the device includes a protective filter for filtering out certain gases or contaminants of the air and in another embodiment the respirator includes a cartridge for adding oxygen to the air which is respirated. The device includes a hand pump for initial circulation of the cooling liquid and also preferably includes a pump which is driven by the vapor generated by the coolant.

11 Claims, 2 Drawing Figures

HEAT AND GAS PROTECTION SUIT

BACKGROUND OF THE INVENTION

1. Field of the Invention

The invention relates in general to body protection devices and in particular to a new and useful heat and gas protection suit including an inner suit containing tubular flow channels to receive a liquid cooling agent, and a cooling device, consisting of a heat eschanger with the coolant, and also including a cooling agent circulating pump driven by coolant vapor, and a respirator.

2. Description of the Prior Art

The human body generates heat continuously by metabolism. Normally this heat is transferred to the environment by radiation, conduction, convection and evaporation. The necessary equilibrium, at which the body temperature does not rise beyond the physiological limits, can be attained only if the ambient can absorb the heat as quickly as it is generated. Direct transfer of the heat from the body becomes impossible, however, if the surrounding temperature becomes greater than the permissible upper limit of the human body temperature.

A gas-heat protection suit is known in whose heat-insulating envelope an inner suit with tubular flow channels for the circulation of a liquid cooling agent is disposed. The respective cooling apparatus is accommodated in a backpack and comprises a vessel containing liquid coolant. By structural measures it is taken from the vessel and used via pressure regulating devices to drive the delivery pump for the cooling agent. The cooling agent flows from the pump through a heat exchanger disposed in the coolant vessel to the flow channels in the inner suit and thence back to the delivery pump. Excess coolant gas escapes into the atmosphere. In addition, the backpack contains a closed-cycle respirator. It is supplied with oxygen from a pressure gas bottle. The exhaled carbon dioxide is retained in an absorber. An inhalation air cooler is provided, which is connected to the cooling agent cycle.

Liquid coolant, e.g. ammonia, is dangerous to handle. Discharging $NH_3$ (ammonia) into the atmosphere in gaseous form is hazardous. Only gaseous coolant should be able to leave the coolant vessel. To be able to dispense always only from the gas phase, a complicated and trouble-prone position compensation is necessary. The protective suit can be used only complete with the respirator, a weight-saving adaptation in the form of a filter device or purely as heat protection does not exist. The oxygen supply from a pressure gas bottle and the additional regeneration cartridge involve a high weight. The circulation of the cooling agent starts with delay after intense evaporation of the coolant has set in. (DT-OS 24 19 524).

Known further is a double-walled protective suit provided with a cooling liquid system. The cooling system of the suit is connected with an outer cooling liquid cycle, in which a heat exchanger cooled by evaporating water provides for the heat transfer from the cooling liquid, and a pump provides for the circulation thereof. In this cycle two additional heat exchangers are arranged, in which respiratory gas and additional oxygen are cooled by the cooling liquid. Also, this cycle has a controllable by-pass between the forward and return branches for temperature regulation and a compensation element for maintaining its internal pressure. The interior of the suit is part of a closed respiratory cycle. In it, the circulation of the respiratory gas occurs by a blower. The exhaled gas coming out of the suit is passed over a carbon dioxide absorber, cooled in a heat exchanger, and sent into the suit again after enrichment with oxygen. The additional oxygen is released from chlorate candles and cooled in a heat exchanger to service temperature. The pump for the cooling liquid and the blower for the respiratory gas are combined in one unit through a magnetic drive and a magnetic coupling and are driven by a common electric motor from a battery. The use of an electric motor and of the heavy battery required for it is disadvantageous. Possible adaptation according to ambient conditions is not provided. A heavy and complicated respirator is used with the device. (U.S. Pat. Ser. No. 3,500,827).

SUMMARY OF THE INVENTION

The invention provides a device which permits easy and rapid adaptation to the environment as needed in addition to cooling, with these alternatives:

(a) in normal atmosphere, without a protective filter,
(b) with a protective filter,
(c) with a respirator, regardless of the surrounding atmosphere.

The construction is such that there is an improved cooling effect and an extension of the effective use time without an increase in weight.

According to the invention, the device includes a system in which a respirator device is selectively connectable into the system. There results as an essential advantage of the invention the adaptation to the surrounding atmosphere possible immediately when required. Without time-consuming conversion, either a protective filter can be connected as a respirator device ahead of the inhaling air line, or a circulation apparatus may be connected, via hanging devices and couplings to the inhalation and exhalation line, with compressed oxygen or liquid oxygen and regeneration of the respiratory air, or with a cartridge filled with potassium dioxide and with a breathing bag. The possibilities of conversion result from the design of all structural parts necessary for the adaptation. Coupling errors are ruled out by strictly consistent design. The suspension and connection of the circulation apparatus are simple and safe.

As a further feature, the cartridge has a double jacket, and the interspect is connected via the overpressure valve with the $CO_2$ gas space in the heat exchanger. A breathing bag is of double-walled construction, and the interspace is traversed by the $CO_2$ gas from the gas motor of the cooling agent delivery pump. These advantageous constructions serve to make work easier and less strenuous for the wearer of the protective suit and to lower the temperature of the respiratory air.

As a further solution of the problem, the coolant is $CO_2$ dry ice and is pressed against the heat exchanger surfaces in the heat exchanger by a pressing device. The pressing device contains pressing springs or is a pressure piston movable by gas. The advantages consist in particular in that handling the $CO_2$ dry ice is safe by comparison with e.g. ammonia. The $CO_2$ discharging during operation represents no danger to the environment or to the wearer when leaks in the cooling system occur.

As a further feature of the invention, a hand pump is inserted in the cooling agent line between the inner suit and the cooling agent delivery pump, so that it is possible in a simple and safe manner to pump the cooling agent by hand during the starting stage, i.e. when use is first started. Thus the desired cooling effect exists from the start.

The inhaling air line, as a cooling channel is applied on the heat exchanger heat-conductively. Thus, the inhaling air taken from the possibly warm surrounding is cooled down in a simple manner to values pleasant to the wearer.

Accordingly it is an object of the invention to provide a suit for the protection of a wearer's body and head from heat gas which comprises an inner suit adapted to cover the wearer's body and head and having a tubular flow channel therethrough for the passage of a cooling liquid and including an outer suit overlying the inner suit and having a body covering and head covering portion including a face mask, with a heat exchanger carried on the outer suit having a coolant chamber with a vaporizable coolant therein and including a coolant vapor driven pump connected to the coolant chamber for receiving vapor from the coolant and connected to the flow channels and to said heat exchanger to circulate the cooling liquid into the heat exchange relationship with the coolant and further including means for circulating respiratory air to the wearer in the face mask.

A further object of the invention is to provide a heat and gas protection suit which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

GENERAL DESCRIPTION OF PREFERRED EMBODIMENTS

Figure 1:
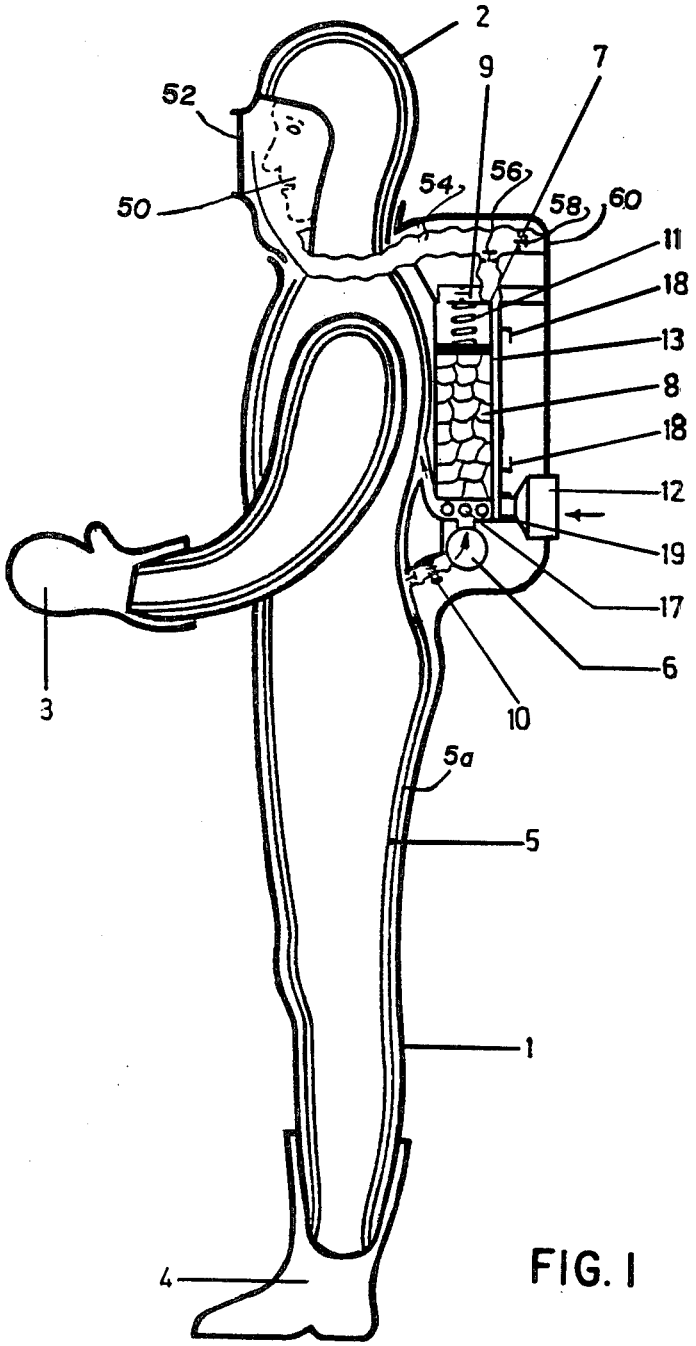
FIG. 1 is an elevational view of a heat and gas protection suit arranged on a wearer and constructed in accordance with the invention.

Referring to the drawings in particular, the invention embodied therein in FIG. 1 comprises a suit for the protection of a wearer 50 which includes an inner suit 5 of double walled construction having a cooling conduit or conduits 5*a* formed between the walls of the double walled inner suit and having a liquid coolant therein which is circulated through the conduits 52 of the suit and into heat exchange association with a heat exchanger 7 by a which has a drive portion driven by vapor and a pumping portion by which the coolant is circulated pump 6. The heat exchanger 7 contains a vaporizable coolant in the form of solid carbon dioxide or dry ice which is maintained under pressure by a pressuring device 11. Vapor from the ice is circulated to the vapor portion of the pump 6 for operating the pump. Respiratory air is circulated by the pumping portion of the pump 6 to the wearer 50 in the vicinity of a face mask portion 52 of a helmet 2 through a protective filter 12 and a respiratory air cooling channel passage 13 and a passage 54 to the vicinity of the nose and mouth of the wearer. In the embodiment of FIG. 1 check valves 56 and 58 permit the inward movement of the air through the protective filter 12 and the passage 13 to the user and the subsequent discharge of the respiratory air out through the check valve 58 to the atmosphere through an opening 60.

Figure 2:
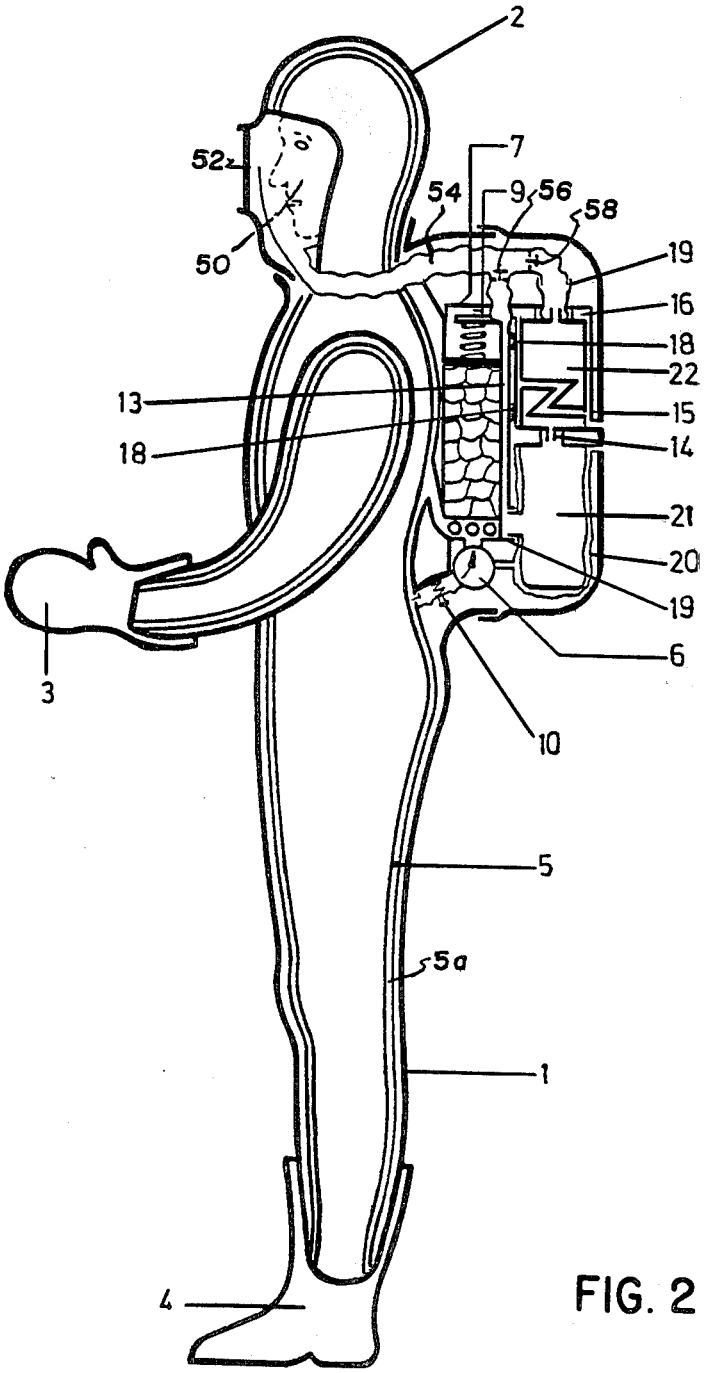
FIG. 2 is a view similar to FIG. 1 of another embodiment of the invention.

A fundamental difference in the construction of the invention of FIG. 1 with that of the embodiment of FIG. 2 is that a filter 12 is not employed in the device of FIG. 2 and the respiratory air is also enriched by oxygen from an oxygen cartridge 22.

The heat and gas protection suit of the invention is an apparatus to be worn as needed. It can be used as follows:

(a) to cool the suit wearer when the ambient air, though breathable as to its composition, is too warm;

(b) by an additional filter in the inhaling air it can be worn also in an atmosphere contaminated with specific gases or suspensoids but otherwise breathable containing enough oxygen;

(c) by the additional equipment with a respirator in the form of a circulation apparatus it can make the wearer entirely independent of the surrounding atmosphere.

The equipments according to (a) and (b) differ only in the protective filter 12 at the intake point for the inhaling air. FIG. 1 shows design (b).

The suit wearer is surrounded by an outer suit 1, which consists in the head region of a helmet 2 and comprises a hand guard 3 and foot guard 4. Depending on the conditions of use, e.g. with respect to temperature and humidity, the material of the outer suit is selected so that use is possible up to 700° C. at relative humidities of over 90%. Besides, it is designed so, e.g. by corresponding surface construction, that the incidence of heat from the outside is minimized.

The inner suit 5 closely hugs the the wearer's body surface. It is double-walled to receive the liquid cooling agent. The cooling agent is a silicone oil which is sufficiently fluid at low temperatures to −80° C. By means of the cooling agent delivery pump 6, driven by a $CO_2$ gas motor, the cooling agent is transported through the inner suit 5 and the heat exchanger 7. During its stay in the inner suit 5, the cooling agent absorbs the heat generated by the wearer and the amount of heat which has come in through the outer suit 1, conducting it to the heat exchanger 7. Heat transfer having taken place, the cooling agent re-enters the inner suit 5 and cools the wearer's body surface. The heat drawn from the cooling agent in the heat exchanger 7 causes sublimation of the coolant present as $CO_2$ dry ice in solid form. The $CO_2$ gas produced is used to drive the gas motor of the cooling agent delivery pump 6. To this end the gas is maintained at a predetermined pressure in the heat exchanger 7 by means of the overpressure valve 9. In the starting stage, i.e. when use first begins, the cooling agent is pumped by means of a hand pump 10.

A safe operation of the heat exchanger 7, independent of position, is achieved through the pressing device 11. This device 11 ensures maximum heat transfer, as it presses the solid $CO_2$ dry ice 8 against the heat exchanger surfaces 17 and thereby prevents the formation of a $CO_2$ gas cushion that would inhibit heat transfer. The pressure device 11 may contain compression and extension springs, or it may be a piston arrangement fed with the generated $CO_2$ gas.

To cool the warm inhaling air from the surrounding atmosphere, the heat exchanger 7 has one or more cooling channels 13. They are interconnected heat-conductively.

In the event of use as outlined in paragraph (b) above, the poisons contained in the inhaling air are removed in the protective filter 12 as shown in FIG. 1.

In the event of use as described in paragraph (c) above, in which a respiration protection independent of the surrounding atmosphere is necessary, additional equipment, as illustrated in FIG. 2, with a respirator becomes necessary. To this end the heat exchanger 7 is provided with hanging devices or support brackets 18 for attachment of a respirator 14. The connection with the inhaling and exhaling line occurs via automatically closing couplings 19. The respirator 14 is a circulation apparatus which possesses in a cartridge 22 of chemically combined oxygen in the form of potassium dioxide ($KO_2$). The oxygen generation is based on the reaction of the $KO_2$ with moisture and with the $CO_2$ in the exhaled air. The result heat of reaction, however, additional increases the temperature of the inhaled air and of the $KO_2$ cartridge 22. To assure the wearer of good breathing comfort, the warmed inhalation air is conducted behind a breathing bag 21 through the cooling channel 13 along the heat exchanger 7 and in so doing is cooled down to normal temperature. Besides, the cold $CO_2$ gas flowing out through the overpressure valve 9 is utilized to cool the cartridge 22. For this purpose the cartridge 22 is provided with a double jacket 15, into the interspace 16 of which the cold $CO_2$ gas is introduced, thereby bringing about the cooling of the cartridge content.

The breathing bag 21 is double-walled, and has an interspace 20 which is traversed by the $CO_2$ gas leaving the gas motor or the cooling agent delivery pump 6. Thereby a good additional cooling of the inhalation air is achieved.

While specific embodiments of the invention have been shown and described in detail to illustrate the application of the principles of the invention, it will be understood that the invention may be embodied otherwise without departing from such principles.

What is claimed is:

1. A suit for the protection of a wearer's body and head from heat and gas, comprising an inner suit encompassing the wearer's body including his head and having at least one tubular flow channel therethrough for the passage of a cooling liquid for cooling the wearer's body, an outer suit overlying said inner suit and including a back portion defining a chamber, a heat exchanger disposed in said back portion and connected to said inner suit and having a coolant chamber, dry ice positioned in said coolant chamber, means for applying pressure to said dry ice, said heat exchanger having a portion with heat exchanger surfaces connected to the flow channel for the passage of the cooling liquid through said heat exchanger portions, pump means for circulating the cooling liquid through said heat exchanger portion and through the flow channel, a respirator mounted in said back chamber having an inhaling passage disposed alongside said heat exchanger and extending to the face of the wearer, check valve means associated with said passage for the inflow of air to the face and for the discharge of the air during expiration from the face to the atmosphere.

2. A suit according to claim 1, wherein said respirator includes an and a protective filter in said inhaling passage.

3. A suit according to claim 1, wherein said respirator includes means for adding oxygen to the respiratory air.

4. A suit according to claim 1, and including an inflatable breathing bag connected in said inhaling passage, an oxygen generating cartridge connected in said inhaling passage for supplying oxygen.

5. A suit according to claim 4, wherein said cartridge includes a double-walled portion with an interspace thereto, said interspace being connected with said heat exchanger coolant chamber and an overpressure valve connected to said cooling chamber permitting escape of the coolant vapor upon the reaching of a predetermined pressure.

6. A suit according to claim 4, wherein said breathing bag comprises a double-walled member having an interspace therebetween connected to said cooling liquid flow channel.

7. A suit according to claim 1, wherein, said heat exchanger has exchanger surfaces having one side over which the coolant liquid is passed and means for pressing the carbon dioxide against the opposite side of said heat exchanger surfaces.

8. A suit according to claim 7, wherein said means for pressing the carbon dioxide includes a spring.

9. A suit according to claim 7, wherein said means for pressing the carbon dioxide coolant comprises a pressure piston.

10. A suit according to claim 1, including a hand pump also connected to said flow channel.

11. A suit according to claim 1, including bracket means on said heat exchanger, a cartridge in said back chamber having oxygen liberating means connected to said respirator, said respirator including passage means for the circulation of breathing air through a breathing bag and into association with said cartridge for liberating oxygen, and coupling means for connection said respirator portion having said breathing bag and said cartridge into said back chamber.

* * * * *